US006930640B2

(12) United States Patent
Chung et al.

(10) Patent No.: US 6,930,640 B2
(45) Date of Patent: Aug. 16, 2005

(54) DUAL FREQUENCY BAND INVERTED-F ANTENNA

(75) Inventors: Shyh-Jong Chung, Hsinchu (TW); Ming-Chou Lee, Hsin Tien (TW); Jason Hsiao, Taipei (TW)

(73) Assignee: GemTek Technology Co., Ltd., Hsinchu (TW)

( * ) Notice: Subject to any disclaimer, the term of this patent is extended or adjusted under 35 U.S.C. 154(b) by 0 days.

(21) Appl. No.: 10/722,539

(22) Filed: Nov. 28, 2003

(65) Prior Publication Data

US 2004/0189530 A1 Sep. 30, 2004

(30) Foreign Application Priority Data

Mar. 28, 2003 (TW) ..... 92107169 A

(51) Int. Cl.[7] ..... H01Q 1/38
(52) U.S. Cl. ..... 343/700 MS; 343/895
(58) Field of Search ..... 343/700 MS, 702, 343/895

(56) References Cited

U.S. PATENT DOCUMENTS 5,929,825 A * 7/1999 Niu et al. ..... 343/895
6,295,029 B1 * 9/2001 Chen et al. ..... 343/700 MS
6,353,443 B1 * 3/2002 Ying ..... 343/702
6,424,315 B1 * 7/2002 Glenn et al. ..... 343/895
6,535,172 B2 * 3/2003 Hirabayashi ..... 343/725
6,552,686 B2 * 4/2003 Ollikainen et al. .. 343/700 MS

* cited by examiner

*Primary Examiner*—Tan Ho
(74) *Attorney, Agent, or Firm*—Troxell Law Office, PLLC

(57) ABSTRACT

A dual frequency band inverted-F antenna used for communicating a low frequency signal and a high frequency signal includes a substrate, a ground metal, a vortical metal structure, a short circuit leg, a feeding leg, and a terminal micro strip. The ground metal and the terminal micro strip are formed on the lower surface of the substrate. The vortical metal structure, formed on the upper surface of the substrate, further has a short circuit end and an open circuit end. The short circuit leg connects electrically the short circuit end of the vortical metal structure with the ground metal. The feeding leg extends along a predetermined direction of the vortical metal structure to couple with a feeding circuit on the substrate. The terminal micro strip connects electrically to the open circuit end through a first conductive aperture. By increasing the encircling number of the vortical metal structure, the coupling effect is generated so that the equivalent wavelength of the high frequency signal can be longer, thus the resonance frequency thereof can be reduced, and so a first frequency can be still kept communicating at a lower frequency band and a second frequency can also be added for communicating at a higher frequency band.

6 Claims, 4 Drawing Sheets

DUAL FREQUENCY BAND INVERTED-F ANTENNA

BACKGROUND OF THE INVENTION (1) Field of the Invention

The invention relates to a design of printed inverted-F antenna, and more particularly to a printed inverted-F antenna for communicating in dual frequency band and having a function of adjusting coupled impedance.

(2) Description of the Prior Art

Rapid innovation and development upon wireless communication technology have made mobile communication products as one of mainstream products nowadays. These mobile communication products include mobile phones, PDAs, notebooks, etc. They can couple with proper communication modules to link a Wireless Local Area Network (WLAN) for transmitting or/and receiving e-mail and instant information such as news, stocks quotations, and so on. In the art, the WLAN is an on-site wireless communication means that utilizes a WLAN card to transmit wirelessly vast data between computer systems. Apparently, in the WLAN, conventional complicated wiring webs have been replaced by wireless communication facilities. One of those wireless communication facilities is the antenna; in particular, a flat inverted-F antenna. The flat inverted-F antenna, characterized on its slim size and light weight, has been widely adopted as a built-in antenna in most of the mobile communication products.

Referring now to FIG. 1 for a conventional compact printed antenna, the antenna includes a substrate 10, a ground metal 12, a strip metal 20, a short circuit leg 14 and a feeding leg 16; in which the ground metal 12, the strip metal 20, the short circuit leg 14 and the feeding leg 16 are all printed circuits located on the substrate 10.

The ground metal 12 is shaped to form a coplanar wave guide (CPW) feeding structure 24 as shown in FIG. 1. The feeding leg 16 grows perpendicularly from the metal strip 20 and extends through the feeding structure 24 to further connect to a matching circuit (not shown in the drawing). The feeding leg 16 and the ground metal 12 are not connected with each other so as to avoid a short circuit problem. The strip metal 20 is parallel with the ground metal 12. The short circuit leg 14 is provided to bridge a short circuit end 18 of the strip metal 20 and the ground metal 12. On other hand, opposing to the short circuit end 18, an open circuit end 22 of the strip metal 20 is formed. The distance between the open circuit end 22 and the short circuit end 18 is preferably one quarter of a concerned wavelength. Alternatively in the art, one of another solutions of the inverted-F antenna is shown in FIG. 2, in which the ground metal 30 and the compact printed antenna including a conductive aperture 32, an open circuit end 34, a feeding leg 36, a metal strip 40, a short circuit end 42 are fabricated respectively on opposing surfaces of the substrate 38.

As the surface size of the compact printed antenna has a restriction that limits the length of the strip metal 20 to one quarter of the wavelength, the size of the antenna is thereby limited to a constant range of one quarter of the wavelength and thus cannot be shrunk effectively. Through the development of passive elements in the contemporary integrated circuits has been targeting at the miniaturization of elements, yet the antenna size of the communication products is still restricted by the unbreakable limitation of one-quarter signal wavelength Besides, the operating frequency of the aforementioned compact printed antenna is limited to a single frequency band. For example, in a wireless local area network (WLAN), the operating frequency is usually located around ISM (Industrial Scientific Medical)2.4 GHz. Recently, noble wireless devices such as blue tooth apparatus are wildly adopted in wireless communication equipments. Hence, the interference problems such as co-channel interference and next-channel interference become much more serious. Also, it must be pointed out that the resonance frequency of the compact printed antenna between 8 GHz and 9 GHz is usually beyond the contemporary communication protocol. Therefore, the present invention is introduced not only to provide a shrunk size to the printed antenna but also to make the antenna operable under a dual-frequency band.

SUMMARY OF THE INVENTION

Accordingly, it is one object of the present invention to provide a dual frequency band inverted-F antenna.

It is another object of the present invention to provide a shrunk size printed inverted-F antenna by using a vortical metal structure.

It is one more object of the present invention to provide a printed inverted-F antenna having the function of adjusting the coupled impedance.

In one embodiment of the present invention, the dual frequency band inverted-F antenna can include a substrate, a ground metal, a vortical metal structure, a short circuit leg, and a feeding leg. The ground metal is formed on a lower surface of the substrate. The vortical metal structure, formed on an upper surface of the substrate, further has a short circuit end and an open circuit end, in which the open circuit end is located within the center of the vortical metal structure. The short circuit leg connects electrically the short circuit end of the vortical metal structure with the ground metal. The feeding leg extends along a predetermined direction of the vortical metal structure to couple with a feeding circuit on the substrate. By increasing the encircling number of the vortical metal structure, the induced coupling effect is then generated so that the equivalent wavelength of the high frequency signal becomes longer and thereby the resonance frequency thereof can be reduced, and hence a first frequency for the antenna to transmit/receive signals can be kept communicating at a lower frequency band while a second frequency can be still added for communicating at a higher frequency band.

In one embodiment of the present invention, the dual frequency band inverted-F antenna can include a substrate, a ground metal, a vortical metal structure, a short circuit leg, a feeding leg, and a terminal micro strip. The ground metal and the terminal micro strip are both formed but separated on a lower surface of the substrate. The vortical metal structure formed on an upper surface of the substrate further has a short circuit end and an open circuit end. The short circuit leg connects electrically the short circuit end of the vortical metal structure with the ground metal. The feeding leg extends along a predetermined direction of the vortical metal structure to couple with a feeding circuit on the substrate. The terminal micro strip connects electrically to the open circuit end through a first conductive aperture and has the function of adjusting the coupled impedance with the feeding circuit. By increasing the encircling number of the vortical metal structure, the induced coupling effect is then generated so that the equivalent wavelength of the high frequency signal becomes longer and thereby the resonance frequency thereof can be reduced. Hence, a first frequency can be introduced to communicate at a lower frequency band, and a second frequency can be also added to communicate at a higher frequency band.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is a printed inverted-F antenna for communication products to transmit and receive signals in dual frequency band (a lower frequency signal and a higher frequency signal) and having the function of adjusting the coupled impedance. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 3:
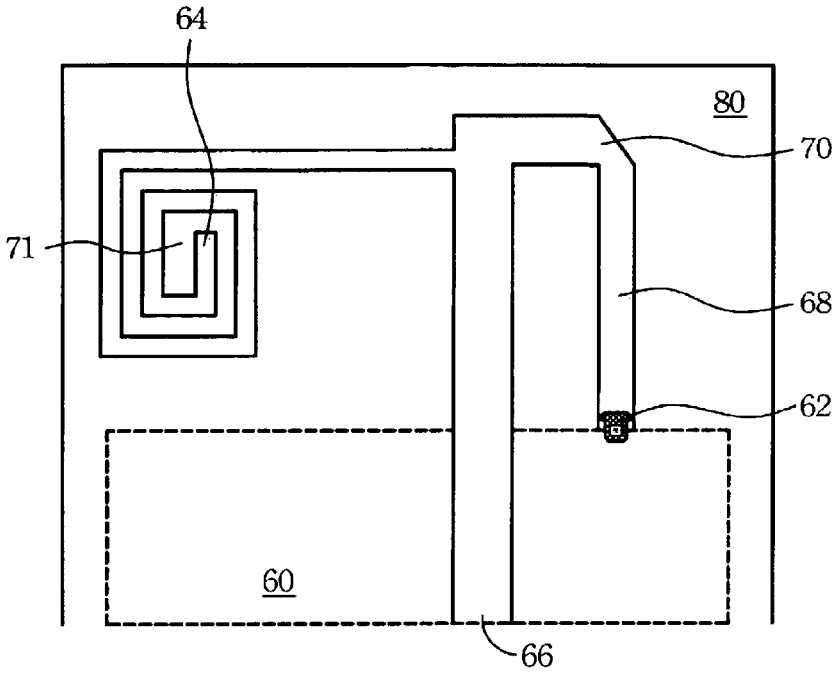
FIG. 3 is a schematic view of a first embodiment of the dual frequency band inverted-F antenna with a smaller encircling number of vortical metal structure according to the present invention.

Referring to FIG. 3 for a first embodiment of the present invention, the dual frequency band inverted-F antenna includes a substrate 80, a ground metal 60, a feeding leg 66, a short circuit leg 68 and a vortical metal structure 71. The substrate 80 is a dielectric material where the ground metal 60, the feeding leg 66, the short circuit leg 68 and the vortical metal structure 71 are formed thereon as printed circuits. Besides, the ground metal 60 shown in a dotted line in the drawing is formed on a lower surface of the substrate 80, and, on the other hand, the other parts of the antenna shown in dark color in the drawing are formed on an upper surface of the substrate 80. The vortical metal structure 71 is formed by an elongated metal strip bending into a vortical structure or made of a sheet of metal by punching into a vortical structure. The vortical metal structure 71 can further have an open circuit end 64 and a short circuit end 70 to form an open circuit-short circuit structure, in which the open circuit end 70 is located within the center of the vortical metal structure 71.

Additionally, the shape of vortical metal structure 71 can be a circular type, an angular type, a square, or the like. The short circuit end 70 connects electrically the ground metal 60 on the other side via the short circuit leg 68 which extends through a penetrating conductive aperture 62. The feeding leg 66 extends along a predetermined direction of the vortical metal structure 71 to couple with a feeding circuit on the substrate 80 (not shown in the drawing).

In foregoing description, the ground metal 60 is located at an opposing surface to that constructing the rest circuits of the printed inverted-F antenna. Yet, in another embodiment of the present invention not shown here, the ground metal 60 and other circuits of printed inverted-F antenna can be still fabricated on the same surface of the substrate 80 with a proper arrangement to avoid any short-circuiting problem .

The distance between the open circuit end 64 and the short circuit end 70 of the antenna is preferable one quarter of the wavelength for the lower operating frequency (i.e., the first frequency) that is the equivalent current path length of the open circuit-short circuit oscillation signal. Upon such an arrangement, the linear distance between the open circuit end 64 and the short circuit end 70 can be shortened and thus the size of the dual frequency band inverted-F antenna can be effectively reduced.

Figure 4:
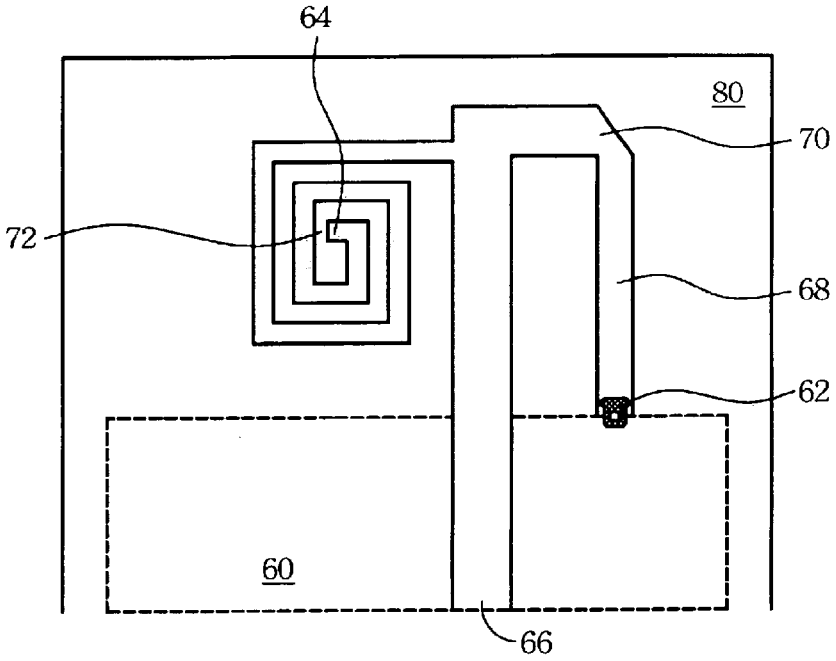
FIG. 4 is a schematic view of a second embodiment of the dual frequency band inverted-F antenna with a larger encircling number of vortical metal structure according to the present invention.

Besides, the vortical metal structure 71 will generate inductance and internal impedance that may be changed and adjusted by altering the number of vortex of the vortical metal structure 71. That is, the dual frequency band inverted-F antenna can be appropriately adjusted so as to meet an individual applicable spectrum, a grounding metal format and an antenna input impedance and so as to increase the freedom for adjusting the input impedance. Furthermore, as shown in FIG. 4, by increasing the encircling number of the vortical metal structure 72, the induced coupling effect can then be generated so that the equivalent wavelength of the operated high frequency signal can become longer and thereby the resonance frequency can be reduced.

Figure 1:
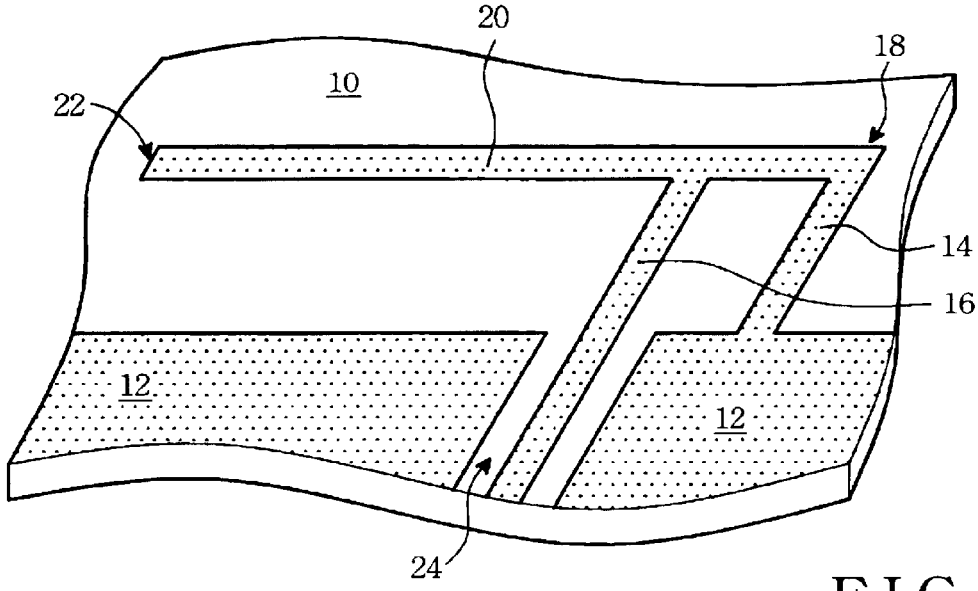
FIG. 1 (Prior Art)
FIG. 1 is a schematic view of a conventional compact printed antenna which is fabricated on the same surface of the substrate.
Figure 2:
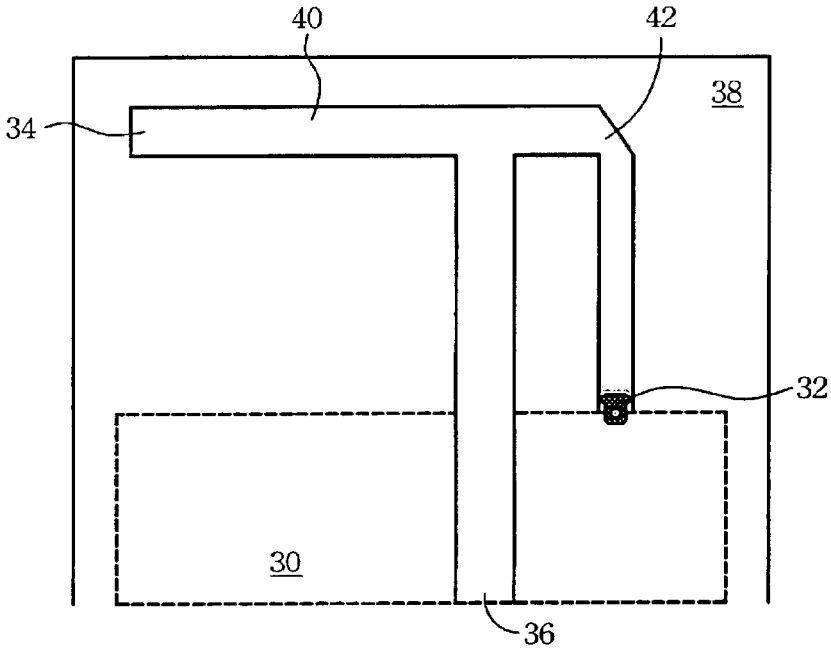
FIG. 2 (Prior Art)
FIG. 2 is a schematic view of a conventional compact printed antenna which is fabricated on different surfaces of the substrate.
Figure 5:
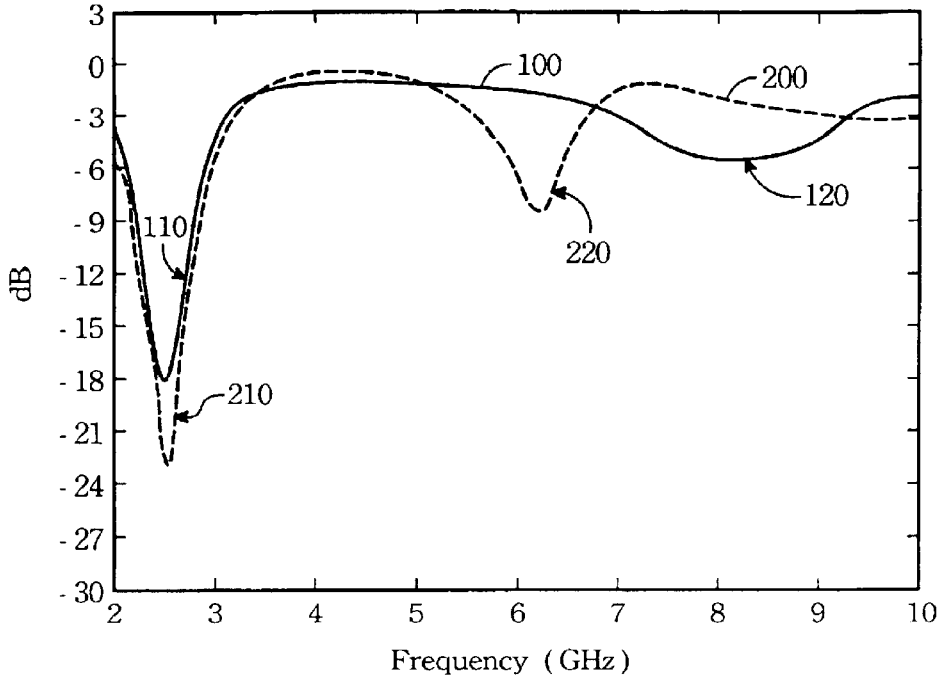
FIG. 5 is a diagram of computer-simulation results illustrating the input return loss versus frequency for the antennas as shown in FIG. 2 and FIG. 3, respectively.
Figure 6:
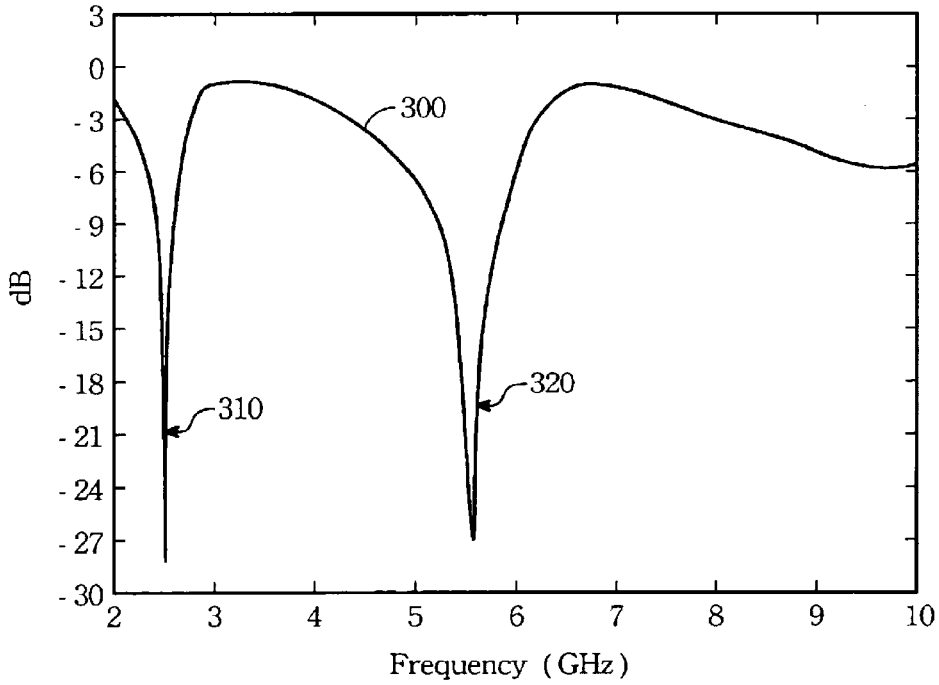
FIG. 6 is a diagram of computer-simulation results illustrating the input return loss versus frequency for the second embodiment of the present invention as shown in FIG. 4.

FIG. 5 shows the computer-simulation results illustrating the input return loss versus frequency for the antennas as shown in FIG. 2 (solid line 100) and FIG. 3 (dotted line 200), respectively. FIG. 6 also shows the computer-simulation results illustrating the input return loss versus frequency for the antenna as shown in FIG. 4 (solid line 300) Line 100 and Line 200 are results obtained respectively from simulating the embodiments shown in FIG. 3 and FIG. 4, in which different numbers of vortex of the vortical metal structure are provided but the linear distance between the open circuit end and the short circuit end in both embodiments is set equal to one quarter of the wavelength for the lower operating frequency (the first frequency). As observed from line 200 and line 300, a higher operating frequency (the second frequency ) in appropriate frequency band for used in communication can be achieved by increasing the encircling number of the vortical metal structure. As shown in FIG. 6, the first operating frequency segment 310 is approximately located at 2.45 GHz and the second operating frequency segment 320 is approximately located between 5 to 6 GHz. In the field of operating in a WLAN, the lower frequency band can be used under the standard of IEEE 802.11b and the higher frequency band can be located at the standard of IEEE 802.11a, HiperLAN1, and HiperLAN2 so that the antenna of the present invention can be operated in dual frequency band.

Figure 7:
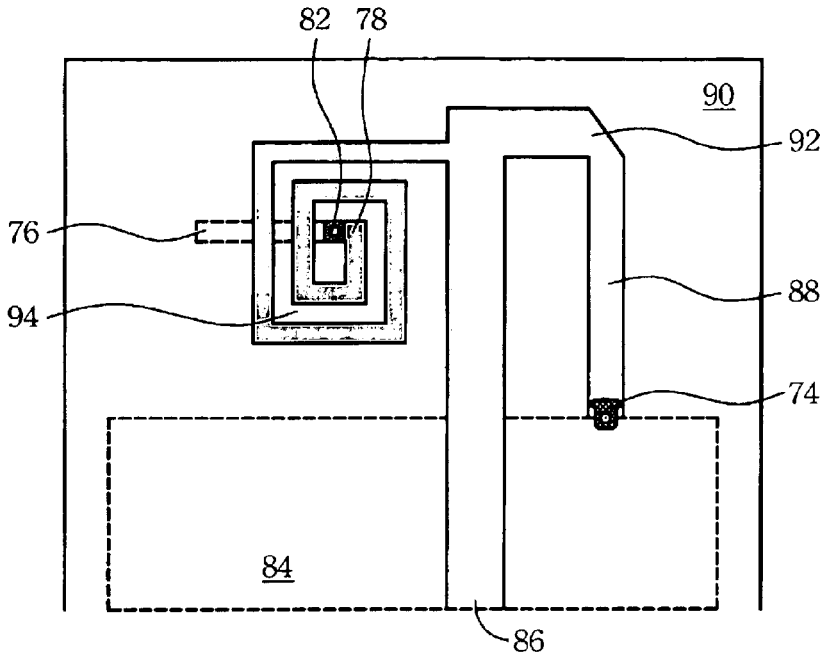
FIG. 7 is a schematic view of a third embodiment of the dual frequency band inverted-F antenna with terminal micro strip according to the present invention.

Referring now to FIG. 7 for a third embodiment of the present invention, the dual frequency band inverted-F antenna can include a substrate 90, a ground metal 84, a feeding leg 86, a short circuit leg 88, a vortical metal structure 94, and a terminal micro strip 76. The substrate 90 is a dielectric material, and the ground metal 84, the feeding leg 86, the short circuit leg 88, the vortical metal structure 94, and the terminal micro strip 76 are formed as printed circuits located on the substrate 90. Besides, the ground metal 84 and the terminal micro strip 76 shown in dotted lines are formed on the back side of the substrate 90, while the other parts of the antenna shown all in solid lines are formed on the front side of the substrate 90. The vortical metal structure 94 is formed by bending an elongated metal strip into a vortical structure or made of a sheet of metal by punching into a vortical structure. The vortical metal structure 94 further provides an open circuit end 78 and a short circuit end 92 to form a open circuit-short circuit structure, wherein the open circuit end 78 is located within the center of the vortical metal structure 94.

Additionally, the shape of vortical metal structure 94 can be a circular type, an angular type, a square, or the like. The terminal micro strip 76 formed on the back side of the substrate 90 can utilize a through first conductive aperture 82 to connects electrically with the open circuit end 78 on the front side. It is also noted that both the terminal micro strip 76 and the ground metal 84 are formed on the same side of the substrate 90 but without any connection in between. The short circuit end 92 connects electrically the ground metal 84 through the short circuit leg 88 and a through second conductive aperture 74. The feeding leg 86 extends along a predetermined direction of the vortical metal structure 94 to couple with a feeding circuit on the substrate 90 (not shown in the drawing).

Nevertheless, in another embodiment not shown here, the ground metal 84 and other circuits of the printed inverted-F antenna (the terminal micro strip 76 is not included) can still be fabricated on the same surface of the substrate 90. Yet, attention upon layouts is still needed to prevent any possible short-circuiting.

The distance between the open circuit end 78 and the short circuit end 92 of the antenna is preferably one quarter of the wavelength for the lower operating frequency (the first frequency) that is the equivalent current path length of the open circuit-short circuit oscillation signal. Therefore, under the arrangement that the equivalent current path length equals to one quarter of the wavelength, the linear distance between the open circuit end 78 and the short circuit end 92 can be shortened and the size of the dual frequency band inverted-F antenna can be effectively reduced.

Accordingly, in one aspect of the present invention typically shown in FIG. 3 or FIG. 4, a higher operating frequency can be achieved through altering the number of vortex of the vortical metal structure 94. However, in another aspect of the present invention typically shown in FIG. 7, the inverted-F antenna can be appropriately adjusted to meet the individual applicable spectrum, the grounding metal format and the antenna input impedance so as to increase the freedom of adjusting the input impedance by adjusting the width, length or direction of the terminal micro strip 76.

Figure 8:
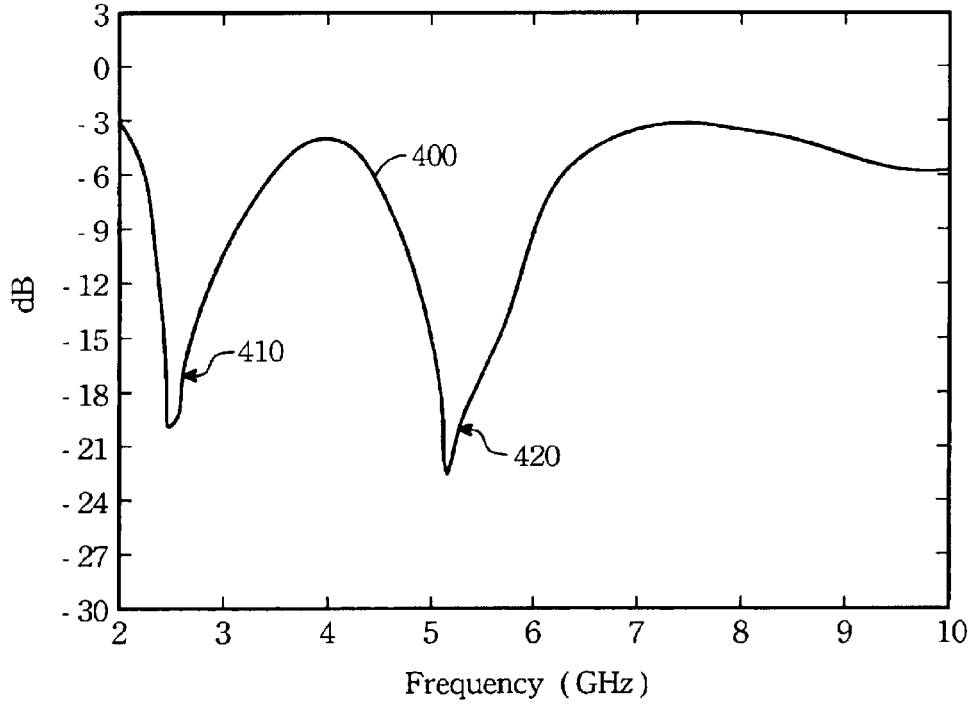
FIG. 8 is a measurement illustrating the input return loss versus frequency for the third embodiment of the present invention as shown in FIG. 7.

Please refer to FIG. 8, which illustrates the input return loss versus frequency for the third embodiment of the present invention as shown in FIG. 7. As shown, the first operating frequency segment 410 is approximately located at 2.45 GHz and the second operating frequency segment 420 is approximately located between 5 to 6 GHz so that the antenna of the present invention can be operated in dual frequency band.

In summary, the dual frequency band inverted-F antenna of the present invention can not only hold the same advantages with the conventional techniques such as compactness, well transmission efficiency, cost-saving toward manufacturing, omni-directional pattern, mixed polarization, and easy tuning to a function equally in most wireless application, but also provides several advantages as follows over the conventional techniques:

(1) By increasing the encircling number of the vortical metal structure in accordance with the present invention, the original lower operating frequency can not only be maintained but also the other higher frequency that enables the inverted-F antenna to be operated in dual frequency band communication can be achieved.

(2) The vortical metal structure of the present invention can maintain the equivalent current path length to one quarter of the wavelength for the lower operating frequency and thereby the size of the antenna can be effectively shrunk.

(3) The vortical metal structure and the terminal micro strip according to the present invention can generate sufficient inductance to adjust the antenna input impedance so that the increasing upon the freedom of the inverted-F antenna coupling impedance is possible.

While the present invention has been particularly shown and described with reference to a preferred embodiment, it will be understood by those skilled in the art that various changes in form and detail may be without departing from the spirit and scope of the present invention.

We claim:

1. A dual frequency band inverted-F antenna for communicating a low frequency signal and a high frequency signal, comprising:

a substrate;

a ground metal, which is formed on a lower surface of said substrate;

a vortical metal structure, which is formed on an upper surface of said substrate, further having a short circuit end and an open circuit end wherein said open circuit end is located within a center of said vortical metal structure;

a short circuit leg, which connects electrically said short circuit end of said vortical metal structure with said ground metal;

a feeding leg, which extends along a predetermined direction of said vortical metal structure to couple with a feeding circuit on said substrate; and a terminal micro strip, which is fabricated on the lower surface of said substrate and connected electrically to said open circuit end through a first conductive aperture;

wherein, by increasing an encircling number of said vortical metal structure to generate a coupling effect so that an equivalent wavelength of said high frequency signal becomes longer and thereby a resonance frequency at a lower frequency band and a second frequency is added for communicating at a higher frequency band.

2. The dual frequency band inverted-F antenna of claim 1, wherein said ground metal connects electrically to said short circuit leg through a second conductive aperture.

3. The dual frequency band inverted-F antenna of claim 1, wherein said terminal micro strip has a function of adjusting a coupled impedance with said feeding circuit.

4. The dual frequency band inverted-F antenna of claim 1, wherein said ground metal, said vortical metal structure, said short circuit leg, said feeding leg, and said terminal micro strip are printed circuits located on said substrate.

5. The dual frequency band inverted-F antenna of claim 1, wherein the equivalent current path length of said open circuit end and said short circuit end is one quarter of a selected wavelength so as to form an open circuit-short circuit structure.

6. The dual frequency band inverted-F antenna of claim 1, wherein said vortical metal structure generates inductance to form internal impedance and thus increases freedom of adjusting input impedance of said dual frequency band inverted-F antenna.

* * * * *